US007550109B2

(12) United States Patent
Lee

(10) Patent No.: US 7,550,109 B2
(45) Date of Patent: Jun. 23, 2009

(54) DOUBLE CHAMBER SINGLE DIRECTIONAL SPIRAL TUYERE FOR BLAST FURNACES

(75) Inventor: Hae-Yang Lee, Incheon (KR)

(73) Assignee: Seoul Engineering Co., Ltd., Incheon (KR)

( * ) Notice: Subject to any disclaimer, the term of this patent is extended or adjusted under 35 U.S.C. 154(b) by 226 days.

(21) Appl. No.: 11/636,908

(22) Filed: Dec. 11, 2006

(65) Prior Publication Data

US 2007/0235910 A1 Oct. 11, 2007

(30) Foreign Application Priority Data

Apr. 11, 2006 (KR) ..... 10-2006-0032896

(51) Int. Cl.
*C21C 5/48* (2006.01)

(52) U.S. Cl. ..... 266/270; 266/265

(58) Field of Classification Search ..... 266/265, 266/270

See application file for complete search history.

(56) References Cited

U.S. PATENT DOCUMENTS 6,446,565 B2 * 9/2002 Stricker et al. ..... 266/265

* cited by examiner

*Primary Examiner*—Scott Kastler
(74) *Attorney, Agent, or Firm*—Cooper & Durham LLP

(57) ABSTRACT

A double chamber single directional spiral tuyere for blast furnaces is disclosed. The tuyere includes a body unit, a spiral unit and a cover unit, with a body chamber having a body nose passage and a body main passage defined in the body unit, and a nose chamber having first, second, third and fourth spiral passages defined in both the spiral unit and the cover unit. The tuyere further includes a tunnel, which is formed in the spiral unit and the cover unit and connects a cooling water inlet to the first spiral passage. Thus, efficient circulation of cooling water and maximum cooling performance can be provided.

1 Claim, 4 Drawing Sheets sectional view along line C–C (a)

development view along line D–D (b)

view from the direction x sectional view along line A-A development view along line B-B sectional view along line C-C (a)

development view along line D-D (b)

DOUBLE CHAMBER SINGLE DIRECTIONAL SPIRAL TUYERE FOR BLAST FURNACES

BACKGROUND OF THE INVENTION

1. Field of the Invention

The present invention relates, in general, to double chamber single directional spiral tuyeres for blast furnaces and, more particularly, to a double chamber single directional spiral tuyere for blast furnaces, which supplies a hot blast having a temperature of about 1200° C. into a blast furnace and has an improved cooling structure capable of increasing the cooling performance of the tuyere, thereby having an increased expected lifespan.

2. Description of the Related Art

Generally, blast furnaces used in iron mills are furnaces for manufacturing pig iron. In a conventional blast furnace, iron ore, such as agglomerated ore or sized ore, which is the raw material, is processed through smelting reduction using reduction gas, thus producing pig iron. During the iron manufacture, the reduction gas is generated by burning coke, which is the fuel, using a hot blast having a temperature of about 1200° C. supplied into the furnace through a tuyere.

In the prior art, a variety of tuyeres has been used for supplying a hot blast into blast furnaces. Among the variety of conventional tuyeres for blast furnaces, a double chamber spiral tuyere having a high cooling capacity has been preferably used. As shown in FIGS. 1 and 2, a conventional double chamber spiral tuyere for blast furnaces comprises a body unit 10, a spiral unit 20 and a cover unit 30. As desired, a hard facing 40 may be further provided on the double chamber spiral tuyere to minimize abrasion and breakage caused by collisions between the fuel and raw material, which drop downwards after being put into the top of the blast furnace.

The above-mentioned conventional double chamber spiral tuyere for blast furnaces has double chamber-type cooling passages. In the field, the technical term "double chamber" means that the tuyere has two chambers, so that, if cooling water leaks in the first chamber due to damage, the cooling water supply for the first chamber is stopped, and the second chamber continues its function, thus allowing the tuyere to temporarily continue its service until replaced.

As shown in FIGS. 2(*a*) and 2(*b*), the conventional double chamber spiral tuyere for blast furnaces comprises two chambers. Described in detail, a first spiral passage 21, a second spiral passage 22, a third spiral passage 23 and a fourth spiral passage 24 defined in the spiral unit 20 form one chamber, which is called a "nose chamber", while a body main passage 11 and a body nose passage 12 defined in the body unit 10 form another chamber, which is called a "body chamber".

In the related art, the above-mentioned double chamber spiral tuyere for blast furnaces has been preferably used in most blast furnaces, and supplies a hot blast under high pressure into a blast furnace through a hot blast outlet nozzle 50, thus causing coke to be burnt by the hot blast in the furnace. To allow the tuyere to resist a high temperature operational atmosphere condition, cooling water is supplied to the body chamber and the nose chamber, thus cooling the tuyere to minimize thermal degradation or thermal damage to the tuyere.

In other words, the double chamber spiral tuyere for blast furnaces is advantageous in that, even if the nose chamber of the tuyere is damaged due to burn or wear, the tuyere can continue its function while the nose chamber, having been damaged is closed and only the body chamber executes its cooling function until a scheduled period before regularly scheduled maintenance has expired.

However, the conventional double chamber spiral tuyere for blast furnaces is problematic in that the flowing direction of cooling water has to reverse at an angle of 180° at the junction between the first spiral passage 21 and the second spiral passage 22 of the nose chamber, as shown in FIGS. 2(*a*) and 2(*b*), thus causing unnecessary pressure loss.

Described in detail, when viewing the hot blast outlet nozzle 50 of the tuyere from the right to the left in the drawings, cooling water flows counterclockwise in the first spiral passage 21 and the third spiral passage 23, thus being supplied to the nose chamber, while cooling water flows clockwise in the second spiral passage 22 and the fourth spiral passage 24, thus being discharged from the nose chamber. Because cooling water circulates in opposite directions in the nose chamber as described above, the flowing direction of the cooling water must reverse at an angle of 180° at a reverse-turning part 25. This is caused by the structural limitation of the cooling passages, in which cooling water having been supplied into the tuyere through a nose inlet 3 does not flow to the first spiral passage 21, but primarily flows to the third spiral passage 23. Due to the spatial limitation of the cooling passages, if such a reverse-turning part 25 is not provided in the cooling passages, the cooling water cannot be circulated to a nose outlet 4 of the tuyere.

Thus, body cooling water, which has been supplied into the body chamber through a body inlet 1, circulates in the body chamber of the tuyere along a passage, as shown by the arrows E in FIG. 2(*b*), prior to being discharged from the tuyere through a body outlet 2. Nose cooling water, which has been supplied into the nose chamber through the nose inlet 3, circulates in the nose chamber of the tuyere along the above-mentioned spiral passages in the sequence ⓐ→ⓑ→ⓒ→ⓓ→ⓔ→ⓕ→ⓖ→ⓗ, in which the cooling water reverses its flowing direction at positions ⓓ and ⓔ and, thereafter, continues circulating prior to being discharged from the tuyere through the nose outlet 4.

Further, the second problematic issue of the conventional double chamber spiral tuyere is, when cooling water flows through the junction at which the spiral unit 20 is in contact with the cover unit 30, cooling water having been supplied into the tuyere cannot flow through a normal passage in the order of the third spiral passage 23→the first spiral passage 21→the second spiral passage 22→the fourth spiral passage 24, but is shunted such that the cooling water directly flows from the third spiral passage 23 to the fourth spiral passage 24. In the above state, the cooling water is discharged without reaching the nose of the tuyere, thus causing loss of flow in the nose chamber and reducing the cooling performance of the tuyere, and reducing the expected lifespan of the tuyere.

SUMMARY OF THE INVENTION

Accordingly, the present invention has been made keeping in mind the above problems occurring in the prior art, and an object of the present invention is to provide a double chamber single directional spiral tuyere for blast furnaces, which is configured to retain the advantages of the conventional double chamber spiral tuyeres and overcome the disadvantages of the conventional double chamber spiral tuyeres, thus maximizing the cooling performance thereof.

In order to accomplish the above objective, the present invention provides a double chamber single directional spiral tuyere for blast furnaces, comprising a body unit, a spiral unit and a cover unit, with a body chamber comprising a body nose passage and a body main passage defined in the body unit, and a nose chamber comprising a first spiral passage, a second spiral passage, a third spiral passage and a fourth spiral passage defined in both the spiral unit and the cover unit, further comprising: a tunnel formed in the spiral unit and the cover unit and connecting a cooling water inlet to the first spiral passage.

The front part of the body chamber is preferably configured in circular passages, thus allowing high speed circular flow of cooling water.

The double chamber single directional spiral tuyere for blast furnaces preferably further comprises a hard facing provided on a nose surface of the cover unit.

The body unit, the spiral unit and the cover unit are preferably made of at least 99.5% pure copper.

The body unit, the spiral unit and the cover unit may be separately manufactured and assembled together into a single body, or may be cast as an integrated structure.

The double chamber single directional spiral tuyere for blast furnaces according to the present invention provides advantages in that a reverse-turning part, at which the flowing direction of cooling water is reversed at an angle of 180°, is eliminated from a cooling passage defined in the nose of the tuyere, so that cooling water can circulate in a single direction in the tuyere, resulting in efficient circulation of the cooling water, reducing pressure loss and enabling cooling water to reach the nose of the tuyere, thereby providing maximum cooling performance of the tuyere. Therefore the invention is named double chamber single directional spiral tuyere.

BRIEF DESCRIPTION OF THE DRAWINGS

The above and other objects, features and other advantages of the present invention will be more clearly understood from the following detailed description when taken in conjunction with the accompanying drawings, in which.

DETAILED DESCRIPTION OF THE INVENTION

Herein below, a preferred embodiment of the present invention will be described with reference to the accompanying drawings.

Figure 1A:
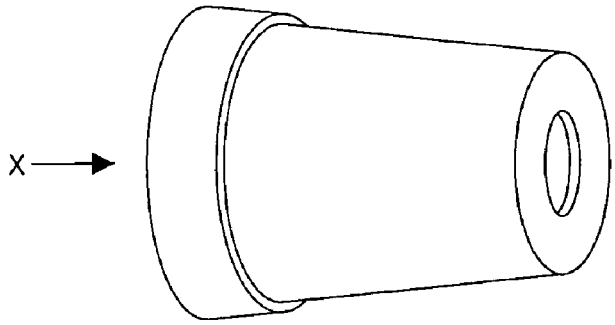
FIG. 1(a) Prior Art
FIG. 1(*a*) and FIG. 1(*b*) are views illustrating a conventional double chamber spiral tuyere for blast furnaces, in which FIG. 1(*a*) is a perspective view, and FIG. 1(*b*) is a view from the direction x of FIG. 1(*a*)
Figure 1B:
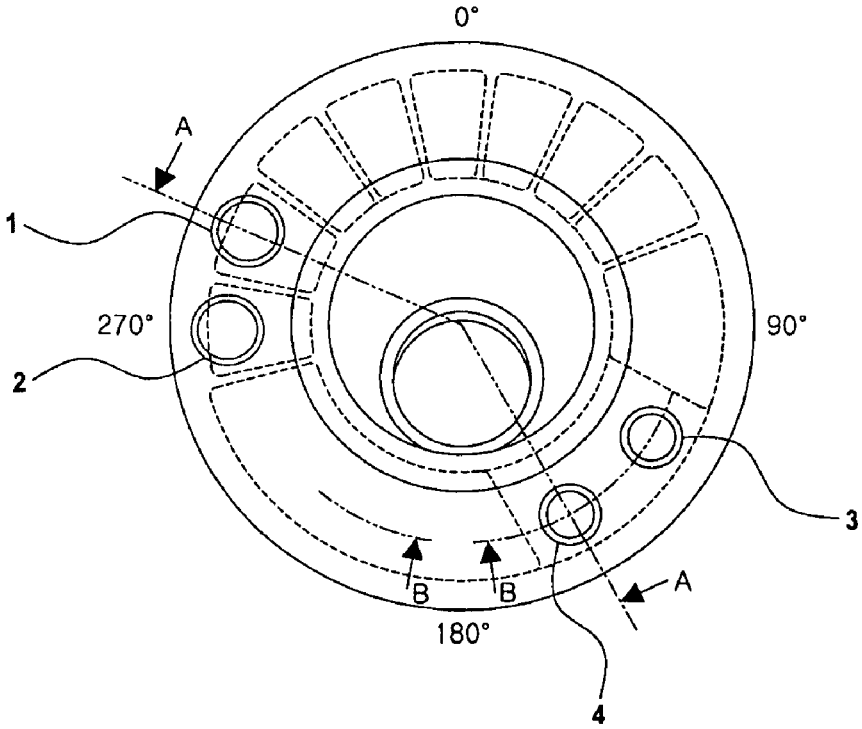
FIG. 1(b) Prior Art
Figure 2A:
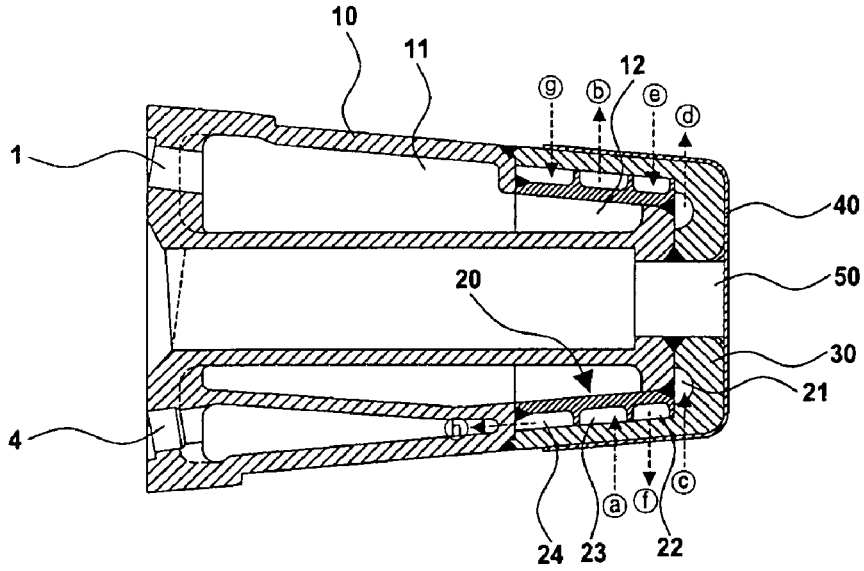
FIG. 2(a) Prior Art
FIG. 2(*a*) and FIG. 2(*b*) are views illustrating cooling passages defined in the conventional double chamber spiral tuyere for blast furnaces, in which FIG. 2(*a*) is a sectional view taken along line A-A of FIG. 1(*b*), and FIG. 2(*b*) is a development view taken along line B-B of FIG. 1(*b*)
Figure 2B:
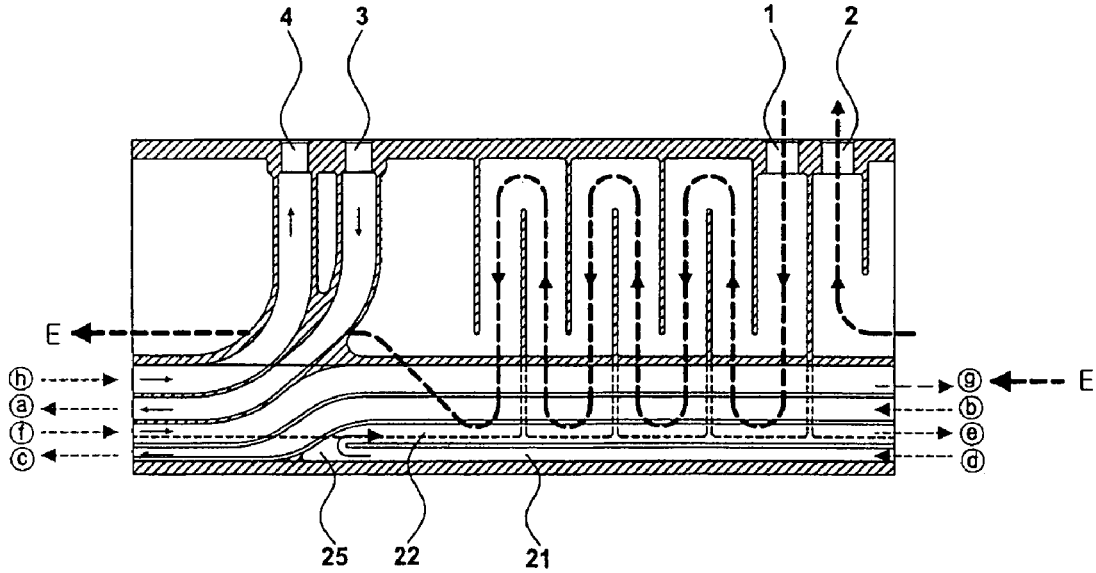
FIG. 2(b) Prior Art
Figure 3:
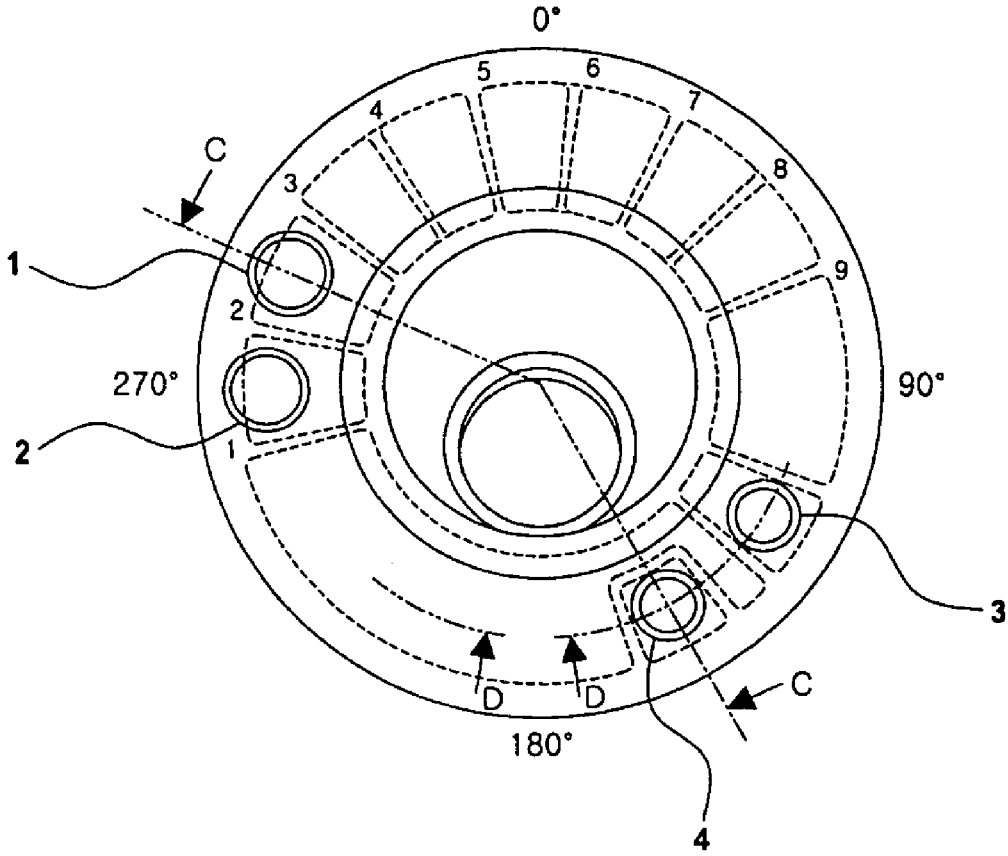
FIG. 3 is a view similar to FIG. 1(*b*), but illustrates a double chamber single directional spiral tuyere for blast furnaces according to the present invention.
Figure 4:
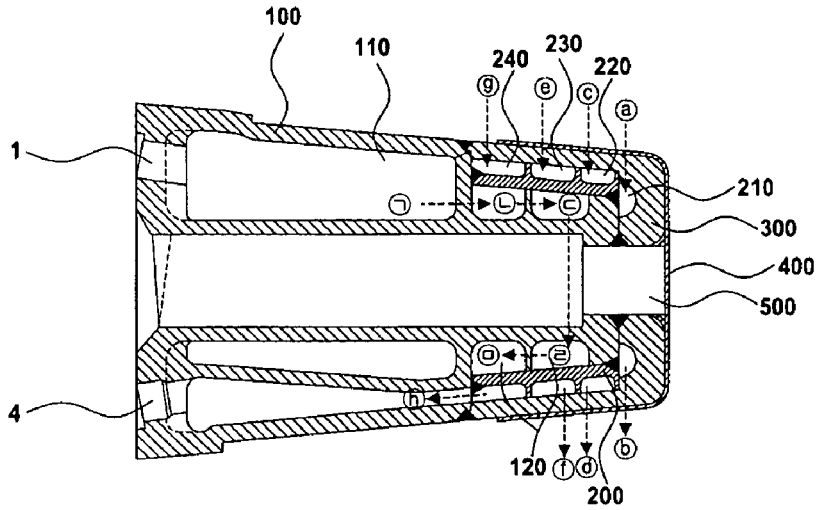
FIG. 4(*a*) and FIG. 4(*b*) are views illustrating cooling passages defined in the double chamber single directional spiral tuyere for blast furnaces according to the present invention, in which FIG. 4(*a*) is a sectional view taken along line C-C of FIG. 3, and FIG. 4(*b*) is a development view taken along line D-D of FIG. 3.
Figure 4:
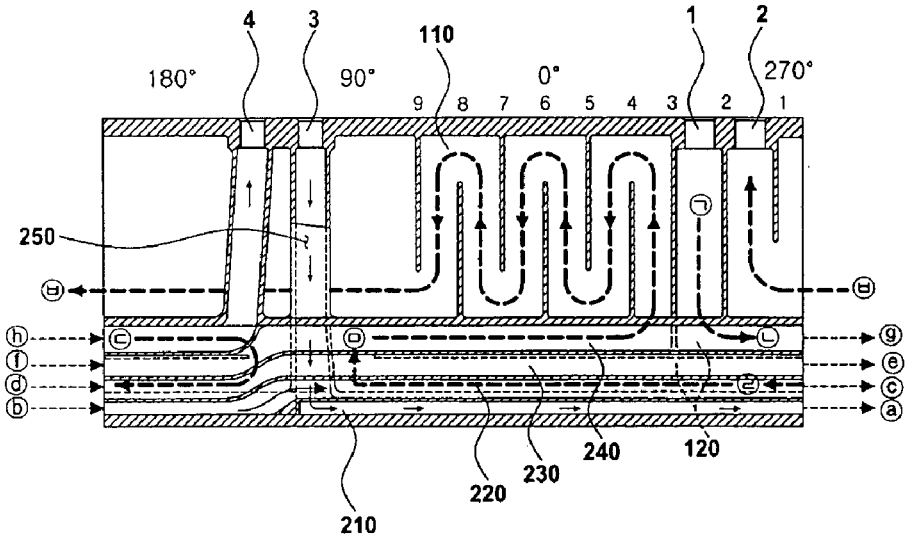

FIG. 3 is a view similar to FIG. 1(*b*), but illustrates a double chamber single directional spiral tuyere for blast furnaces according to the present invention. FIG. 4(*a*) and FIG. 4(*b*) are views illustrating cooling passages defined in the double chamber single directional spiral tuyere for blast furnaces according to the present invention, in which FIG. 4(*a*) is a sectional view taken along line C-C of FIG. 3, and FIG. 4(*b*) is a development view taken along line D-D of FIG. 3.

As shown in FIGS. 3 and 4, in the same manner as that described for a conventional double chamber spiral tuyere for blast furnaces, the double chamber single directional spiral tuyere for blast furnaces according to the present invention comprises a nose chamber comprising a first spiral passage 210, a second spiral passage 220, a third spiral passage 230 and a fourth spiral passage 240, and a body chamber comprising a body main passage 110 and a body nose passage 120.

In the double chamber single directional spiral tuyere, a body unit 100, a spiral unit 200 and a cover unit 300 may be separately manufactured prior to being assembled together into a single body. Alternatively, the body unit 100, the spiral unit 200 and the cover unit 300 may be cast into an integrated structure.

Because the tuyere is typically used at high temperature and high pressure operational atmosphere conditions and must have high thermal conductivity, the tuyere is preferably made of at least 99.5% pure copper.

Furthermore, in a conventional manner, the tuyere may be provided with a hard facing 400 on a nose surface thereof.

The hard facing 400 is preferably made of a nickel-chrome alloy and has the same function as that described for the prior art.

As shown in FIGS. 4(*a*) and 4(*b*), the tuyere of the present invention is configured to directly supply cooling water from a nose inlet 3 to the first spiral passage 210 of the nose chamber through a water passage, such as a tunnel 250.

Therefore, cooling water, having been supplied into the nose chamber, can flow through a passage in the order of the first spiral passage 210→the second spiral passage 220→the third spiral passage 230→the fourth spiral passage 240. Therefore, when viewing a hot blast outlet nozzle 500 of the tuyere from the right to the left in the drawings, the cooling water does not flow in opposite directions. Thus, unlike the conventional tuyere, the tuyere of the present invention is free from any reverse-turning part at which the flowing direction of the cooling water is reversed at an angle of 180°.

In the nose chamber, cooling water, which has been supplied into the nose chamber through the nose inlet 3, circulates along the spiral passages in the sequence ⓐ→ⓑ→ⓒ→ⓓ→ⓔ→ⓕ→ⓖ→ⓗ without reversing its flowing direction, and is discharged from the tuyere through the nose outlet 4.

Furthermore, unlike the conventional double chamber spiral tuyere, the body nose passage 120 of the body chamber in the double chamber single directional spiral tuyere according to the present invention has a minimized sectional area, and is configured to have the same circular passage as that of the spiral unit 200, thus allowing high speed circular flow of cooling water in the body chamber. Therefore, the tuyere of the present invention quickly improves the cooling performance in the nose of the body unit 100.

In the body chamber, cooling water, which has been supplied into the body chamber through a body inlet 1, circulates in the sequence ⓘ→ⓙ→ⓚ→ⓛ→ⓜ→ⓝ, and is discharged from the tuyere through a body outlet 2.

During operation of the tuyere according to the present invention, nose chamber cooling water starts flowing at the first spiral passage 210 due to the tunnel 250. Thus, although cooling water flows through the junction at which the spiral unit 200 is in contact with the cover unit 300, the cooling water supply rate for the first spiral passage 210, which bears the highest thermal load and requires high cooling performance, can be maintained at 100%.

Therefore, the double chamber single directional spiral tuyere for blast furnaces of the present invention has excellent cooling performance in comparison with the conventional tuyere, which causes a reduction in the cooling performance due to the reduction of a supply rate of cooling water for the first spiral passage 210.

Furthermore, unlike the conventional tuyere, the tuyere of the present invention is free from pressure loss caused by the reversal of the flowing direction of cooling water at an angle of 180°. Thus, the nose cooling water can more efficiently flow because the cooling water in the spiral unit 200 circulates in a single direction.

In the tuyere according to the present invention, the body main passage 110 has a reduced sectional area and allows high speed circular flow of cooling water in the same manner as does the spiral unit 200, therefore the cooling performance in the nose of the body unit 100 of the tuyere is improved in comparison with the conventional tuyere.

As described above, the present invention provides a double chamber single directional spiral tuyere for blast furnaces, in which a reverse-turning part, at which the flowing direction of cooling water is reversed at an angle of 180°, is eliminated from a cooling passage defined in the nose of the tuyere. Thus, cooling water can circulate in a single direction in the tuyere, resulting in efficient circulation of the cooling water. The tuyere also reduces pressure loss and causes cooling water to reach the nose of the tuyere, thereby providing maximum cooling performance.

Although the preferred embodiment of the present invention has been disclosed for illustrative purposes, those skilled in the art will appreciate that various modifications, additions and substitutions are possible, without departing from the scope and spirit of the invention as disclosed in the accompanying claims.

What is claimed is:

1. A double chamber single directional spiral tuyere for blast furnaces, comprising a body unit (100), a spiral unit (200) and a cover unit (300), with a body chamber comprising a body main passage (110) and a body nose passage (120) defined in the body unit (100), and a nose chamber comprising a first spiral passage (210), a second spiral passage (220), a third spiral passage (230) and a fourth spiral passage (240) defined in both the spiral unit (200) and the cover unit (300), further comprising:

a tunnel (250) supplying a nose cooling water from nose inlet (3) directly to the first spiral passage (210), wherein the body nose passage (120) of the body chamber is configured as circular passages, thus improving cooling performance in the nose of the body unit (100).

* * * * *